US009028299B2

(12) United States Patent
Yu et al.

(10) Patent No.: US 9,028,299 B2
(45) Date of Patent: May 12, 2015

(54) FULLY SYMMETRIC CUTTER GRINDING MACHINE WITH 5-AXIS AND GRINDING WHEEL HEAD BRACKET THEREOF

(71) Applicant: Dalian Kede Numerical Control Co., Ltd., Dalian (CN)

(72) Inventors: Dehai Yu, Dalian (CN); Xingjian He, Dalian (CN); Chungang Cai, Dalian (CN); Jingming Li, Dalian (CN); Hu Chen, Dalian (CN); Zidan Ju, Dalian (CN); Changlin Du, Dalian (CN)

(73) Assignee: Dalian Kede Numerical Control Co., Ltd., Dalian (CN)

( * ) Notice: Subject to any disclaimer, the term of this patent is extended or adjusted under 35 U.S.C. 154(b) by 49 days.

(21) Appl. No.: 14/036,735

(22) Filed: Sep. 25, 2013

(65) Prior Publication Data

US 2014/0030965 A1 Jan. 30, 2014

Related U.S. Application Data

(63) Continuation of application No. PCT/CN2011/079026, filed on Aug. 28, 2011.

(30) Foreign Application Priority Data

Mar. 25, 2011 (CN) ..... 2011 1 0073436

(51) Int. Cl.

| | |
|---|---|
| ***B24B 5/06*** | (2006.01) |
| ***B24B 27/00*** | (2006.01) |
| ***B24B 41/02*** | (2006.01) |
| ***B24B 47/10*** | (2006.01) |

(52) U.S. Cl.

CPC ..... *B24B 27/0076* (2013.01); *B24B 41/02* (2013.01); *B24B 47/10* (2013.01)

(58) Field of Classification Search

USPC ..... 451/264, 275, 294, 340

See application file for complete search history.

(56) References Cited

U.S. PATENT DOCUMENTS

| | | | | | |
|---|---|---|---|---|---|
| 1,870,764 | A | * | 8/1932 | Aeppli | 451/264 |
| 3,753,319 | A | * | 8/1973 | Mesey | 451/134 |
| 6,145,178 | A | * | 11/2000 | Green | 29/26 A |
| 6,332,386 | B1 | | 12/2001 | Popp | |

FOREIGN PATENT DOCUMENTS

| | | |
|---|---|---|
| CN | 2187092 | 1/1995 |
| CN | 2681852 | 3/2005 |
| CN | 101386150 | 3/2009 |
| DE | 3943546 | 5/1991 |

* cited by examiner

*Primary Examiner* — Lee D Wilson
*Assistant Examiner* — Shantese McDonald
(74) *Attorney, Agent, or Firm* — Hamre, Schumann, Mueller & Larson, P.C.

(57) ABSTRACT

A fully symmetric cutter grinding machine with 5-axis includes a grinding machine base and a pillar, sliding rails are vertically arranged on an inside of the pillar, the sliding rails are provided with a grinding wheel head bracket, the grinding wheel head bracket comprises torque motors vertically provided, a lower part of the torque motor is connected to a horizontally provided spindle by means of a bearing of a rotation table, grinding wheels rotating around an axis of the spindle are symmetrically provided at two sides of the spindle, the grinding wheel head bracket further comprises a big rotatable pulley provided at an upper part of the grinding wheel head bracket and driven to rotate by spindle motors, the big pulley is connected to a spindle pulley by a wide synchronous belt.

5 Claims, 5 Drawing Sheets

FULLY SYMMETRIC CUTTER GRINDING MACHINE WITH 5-AXIS AND GRINDING WHEEL HEAD BRACKET THEREOF

BACKGROUND OF THE INVENTION

1. Technical Field

The present invention relates to a grinding machine, and more particularly, to a grinding machine for machining cutters.

2. Description of Related Art

A grinding machine can be used to grind a surface of a workpiece by a grinding tool, and most grinding machines grind a workpiece by a high speed rotating grinding wheel. However, in the prior art, a lot of heat will be generated during grinding process, so the grinding wheel, the ground workpiece, a bed body of the grinding machine and a transmission part of the grinding machine may occur thermal deformation, thus, machining accuracy is effected.

BRIEF SUMMARY OF THE INVENTION

The object of the present invention is to provide a cutter grinding machine with 5-axis. The present invention changes the structure of the bed body and adopts a symmetric design in order to improve stability of the structure and easily implement error compensation. Thus machining error can be reduced, machining accuracy, machining technology and machining efficiency are improved, and service life of the grinding machine is extended.

The present invention adopts the following technical solutions to solve the technical problem:

A fully symmetric cutter grinding machine with 5-axis, including a grinding machine base and a pillar arranged on one side of the grinding machine base, sliding rails are vertically arranged on an inside of the pillar, the sliding rails are provided with a grinding wheel head bracket movable along the sliding rails, the grinding wheel head bracket includes torque motors vertically provided, a lower part of the torque motor is connected to a horizontally provided spindle by means of a bearing of a rotation table, grinding wheels rotating around an axis of the spindle are symmetrically provided at two sides of the spindle, the grinding wheel head bracket further includes a big rotatable pulley provided at an upper part of the grinding wheel head bracket, the big pulley is connected to a spindle pulley by a wide synchronous belt, the spindle pulley is disposed around a middle of the spindle so as to drive the spindle to rotate, two spindle motors are symmetrically arranged at two ends of a center shaft of the big pulley, the two symmetrical spindle motors are used for synchronously driving the center shaft of the big pulley to rotate.

Preferably, the big pulley is connected to an upper small pulley by a narrow synchronous belt so as to drive the small pulley to rotate, and the small pulley is connected to a rotation shaft of an encoder.

Furthermore, the grinding machine base is a casting stone or natural marble with good rigidity, high hardness, no deformation, therefore, there isn't special requirement for the shape and structure of the grinding machine base made of the casting stone or the natural marble.

Alternatively, the grinding machine base is made of metal, an upper surface of the grinding machine base is circular, the pillar is curved with a radian of 180° along a side edge of the base, a groove body on the circular base is enclosed by a curved vertical plate on the another side edge, and the height of vertical plate is lower than that of the pillar.

In addition, preferably, cross-shaped sliding platforms are symmetrically arranged on a working table of the grinding machine base, a clamp is provided on the sliding platforms, therefore, a ground workpiece can be moved arbitrarily, the freedom degree of the move of the ground workpiece is increased, and the application scope of the grinding machine is extended.

Additionally, an inner side of the vertical plate used for enclosing the groove body is a slope surface, the vertical plate is provided on an outer side of the outer edge of the base, the groove body is formed by the slope surface, enclosing plates arranged on two ends of the curved vertical plate and the circular upper surface of the base.

The present invention also provides a grinding wheel head bracket, the grinding wheel head bracket includes:

torque motors vertically provided, wherein a lower part of the torque motor is connected to a horizontally provided spindle by means of a bearing of a rotation table, grinding wheels rotating around an axis of the spindle are symmetrically provided at two sides of the spindle; and a big rotatable pulley provided at an upper part of the grinding wheel head bracket, wherein the big pulley is connected to a spindle pulley by a wide synchronous belt, the spindle pulley is disposed around a middle of the spindle so as to drive the spindle to rotate, two spindle motors are symmetrically arranged at two ends of a center shaft of the big pulley, the two symmetrical spindle motors are used for synchronously driving the center shaft of the big pulley to rotate.

The inventive cutter grinding machine with 5-axis has a symmetric whole structure, therefore the machining error is reduced, the stability of the structure is improved and the error compensation can be implemented easily. In particular, according to the structure of the inventive grinding machine, the curved pillar and the grinding wheel head bracket are provided together, which makes the fixation of the grinding wheels more stable. Meanwhile, the provided rails are convenient for free move of the grinding wheels for the cutters. Furthermore, the grinding wheels are driven to rotate by the vertical torque motors, the interference between the grinding wheels, the pillar and other parts is not introduced, so that the grinding wheels can freely rotate for 360 degrees. With regarding to the design of the invention, the motors for driving the grinding wheels to rotate is provided on the upper of the grinding machine, instead of on the lower of the grinding machine as described in the prior art, which further makes the machining space for the grinding wheels, thus the grinding wheels are able to freely rotate. At the same time, two motors are used for driving the grinding wheels to rotate by means of belt drive, therefore the driving force of the grinding wheels during the machining process is large enough to satisfy the different requirements of machining strength. Furthermore, since two motors are symmetrically provided, the stability of the grinding machine is improved, which specially solves the problem of heat dissipation and machining error caused by heat deformation, and reduces the vibration of the grinding machine during the machining, thus error compensation can be easily implemented and finally the machining with high accuracy is obtained. At present, there isn't a grinding machine having grinding wheels that can freely rotate for 360 degrees in longitudinal direction used for machining process at home and abroad. However, according to the inventive cutter grinding machine with 5-axis, hollow torque motors are used to drive the grinding wheels to freely rotate, and the spindle motors connected in series are provided on the upper of the torque motors in mirror symmetry, output shafts of the two spindle motors rotate in the same direction and drive the grinding wheels to rotate around a center line by means of a center belt. Thus a totally balanced structure is obtained and can satisfy the requirements of dynamic features of the grinding machine, it also makes temperature fields uniform, it is easy for temperature compensation and compensation of deformation error. The two provided spindle motors increase output power and improve grinding efficiency. The grinding wheels can be driven to rotate for ±360° by means of the grinding spindle, therefore machining technology and machine efficiency are improved, the service life is extended, the machine error is reduced, and it is easy for temperature compensation. The service life of the grinding machine is extended.

In summary, the inventive fully symmetric cutter grinding machine with 5-axis is the first cutter grinding machine with 5-axis in which a lead screw and a linear motor can be interchanged and has following advantages:

1. The symmetric structure is useful to solve the machining error caused by the heat deformation.

2. Two motors are used in the grinding wheel head bracket, the drive from the two motors is fully symmetric, the spindle of the grinding wheels is able to rotate for 360°.

3. The symmetric structure is useful to improve the stability of the structure, it makes temperature fields uniform and is easy for the error compensation.

4. The performance of the machining technology is good, the machining efficiency and the machining accuracy are high.

5. The service life of the machine is extended, and the machine cost is further reduced.

DETAILED DESCRIPTION OF THE INVENTION

Figure 1:
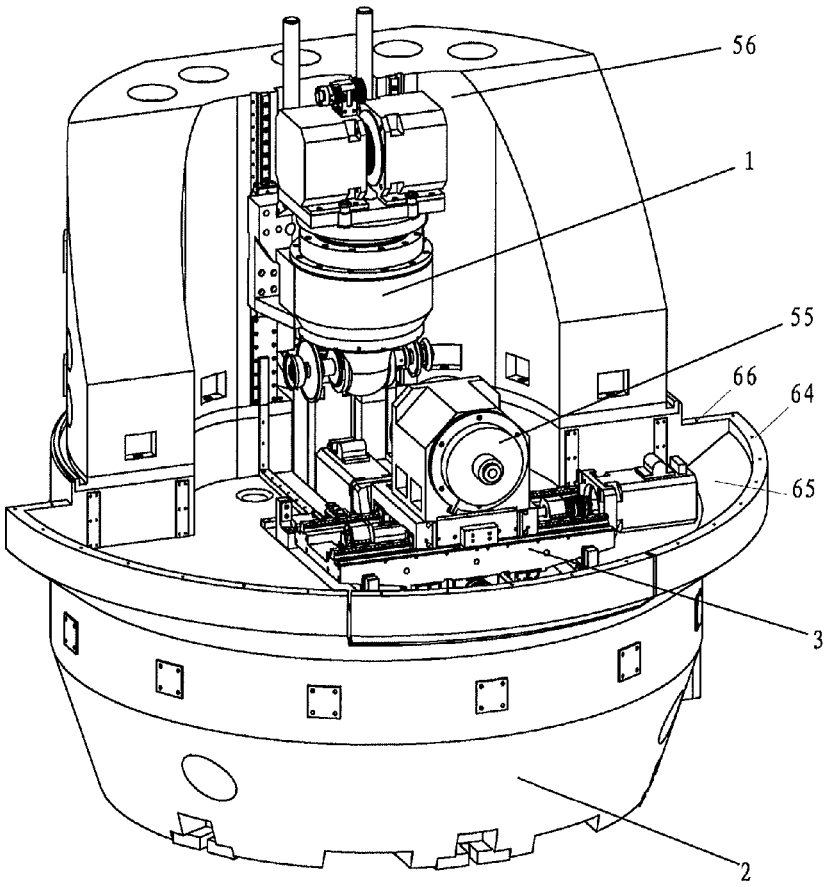
FIG. 1 is a schematic perspective structure view of a fully symmetric cutter grinding machine with 5-axis according to the present invention.
Figure 2:
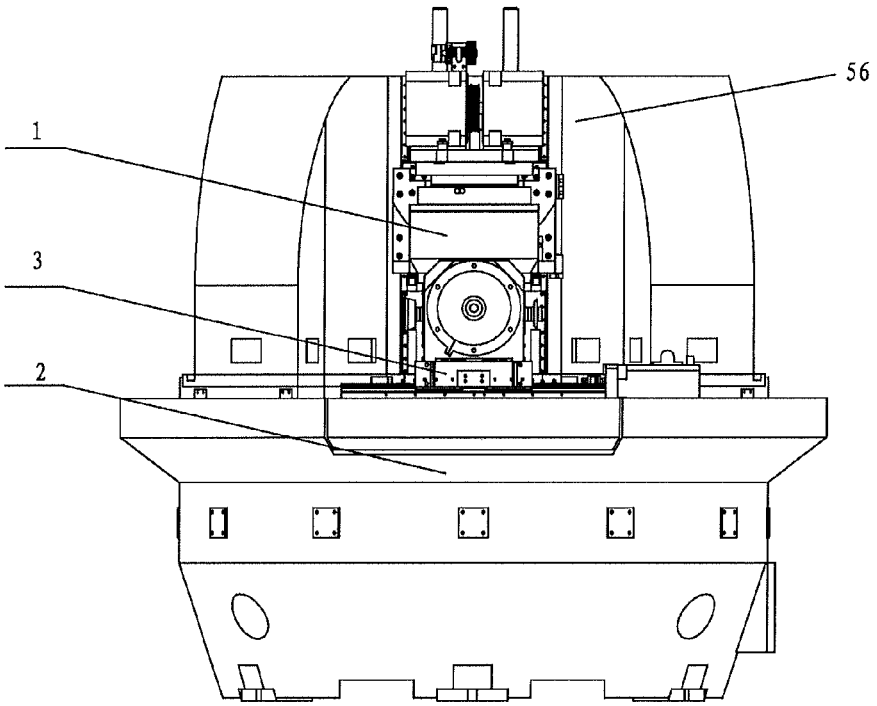
FIG. 2 is a schematic front structure view of the fully symmetric cutter grinding machine with 5-axis according to the present invention.
Figure 3:
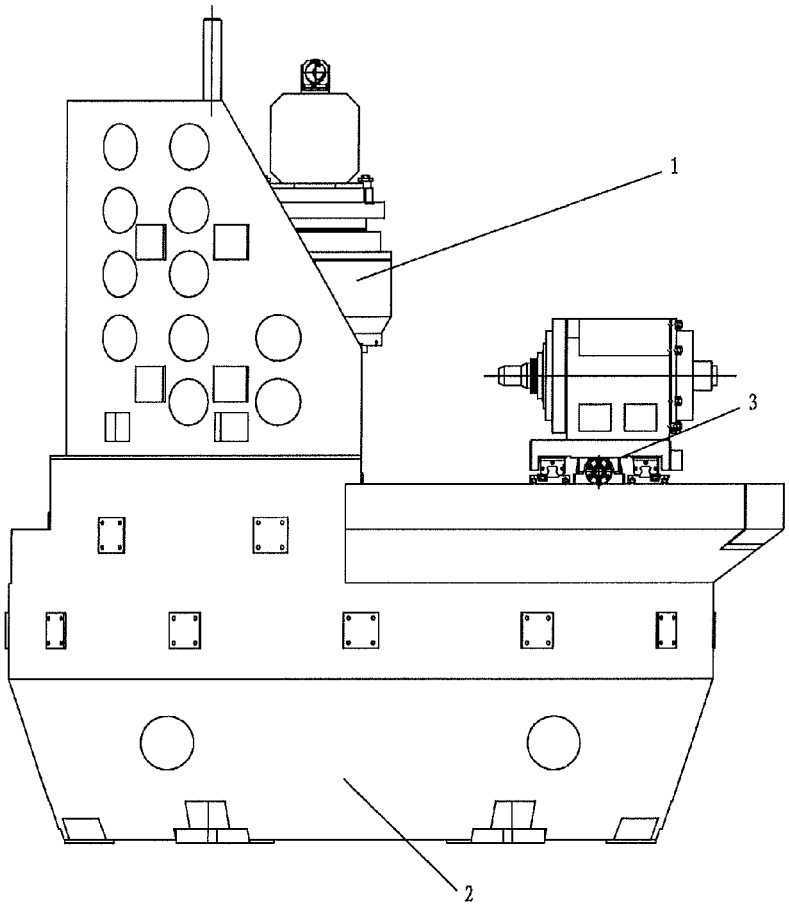
FIG. 3 is a schematic side structure view of the fully symmetric cutter grinding machine with 5-axis according to the present invention.

As shown in FIG. 1 to FIG. 4, according to the present invention, a fully symmetric cutter grinding machine with 5-axis is provided, the cutter grinding machine includes a grinding machine base 2, a pillar 56 arranged on the grinding machine base 2 at one side of the cutter grinding machine. In FIG. 1, there is a surface of a working table on an upper portion of the grinding machine 2, cross-shaped sliding platforms are provided on the surface of the working table, and a clamp used for holding a grinding workpiece is provided on the sliding platforms. In FIG. 2, sliding rails 4 are provided on a vertical surface of an inside of the pillar 56, the sliding rails 4 are provided with a grinding wheel head bracket 1 thereon, the grinding wheel head bracket may slid on the sliding rails 4 up and down and may be stopped at a working position at which a workpiece needs to be machined according to a user's requirement. In particular, two bearing pedestals are vertically mounted on the pillar, a lead screw is provided between the two bearing pedestals used to support two ends of the lead screw. A lead screw nut is provided on the lead screw, the lead screw is mounted on the grinding wheel head bracket, a lower end of the lead screw is connected to a servo motor by a joint slack, the lead screw is driven to rotate by means of rotation of the servo motor, the lead screw nut is driven to move in line along the lead screw by means of rotation of the lead screw, and then the grinding wheel head bracket is driven to move up and down by the lead screw nut.

Figure 5:
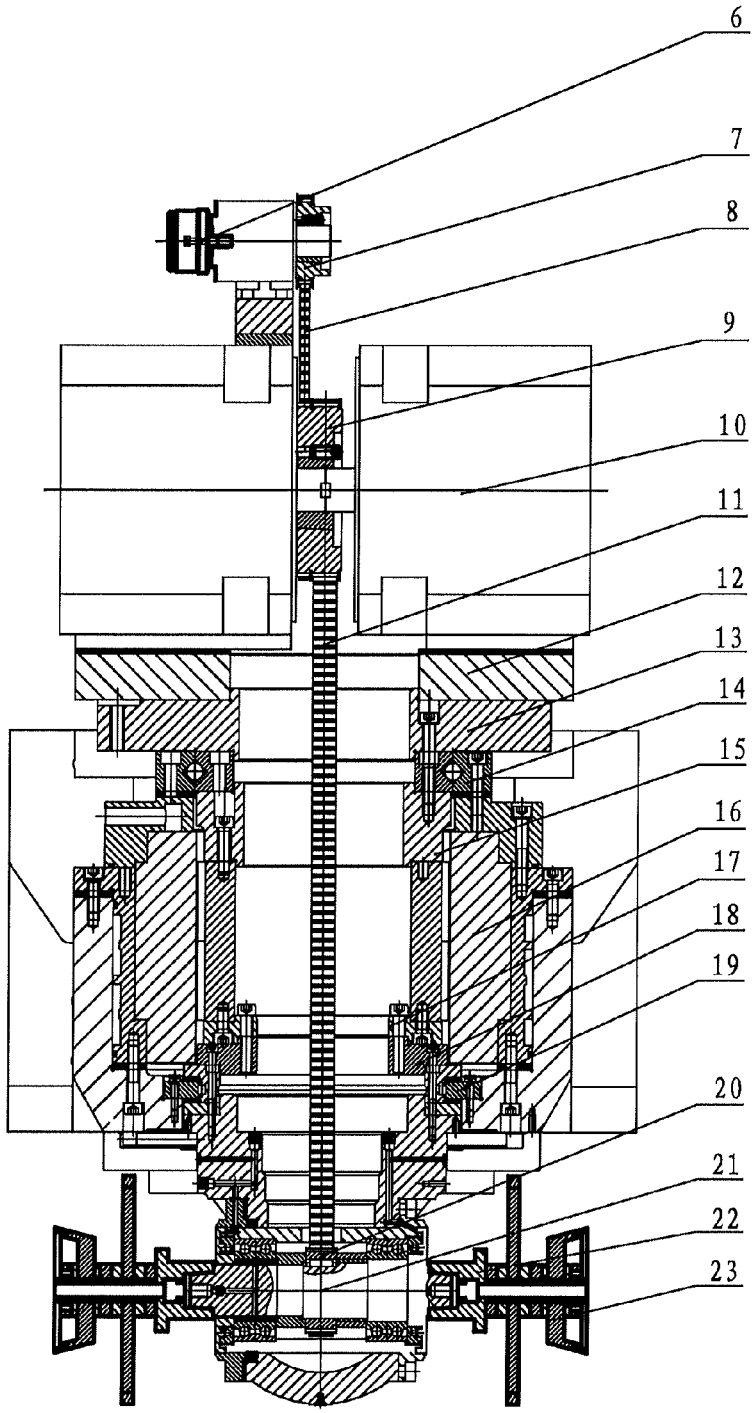
FIG. 5 is a schematic cross-sectional structure view of a grinding wheel head bracket of the fully symmetric cutter grinding machine with 5-axis according to the present invention.

As shown in FIG. 5, the grinding wheel head bracket 1 includes torque motors 16 which are vertically arranged, a lower part of the torque motor 16 is connected to a spindle 21 which is horizontally arranged by means of a bearing of a rotation table. Two sides of the spindle 21 are connected to grinding wheels 23 that can rotate around an axis of the spindle, the grinding wheels are different and can be symmetrically arranged as a plurality of sets so as to satisfy various requirements of grinding processing. Additionally, the grinding wheel head bracket 1 further includes a big pulley 9 provided at an upper part of the grinding wheel head bracket and driven to rotate by two spindle motors 10, the big pulley 9 is connected to a spindle pulley 20 by a wide synchronous belt 11, the spindle pulley 20 is disposed around a middle of the spindle 21 so as to drive the spindle 21 to rotate. Preferably, the two spindle motors 10 are symmetrically arranged at two ends of a center shaft of the big pulley 9 which may be symmetrically driven to rotate by the symmetrically arranged spindle motors 10. Particularly, for example, the spindle motors may be AC permanent magnet synchronous exterior rotor motors that symmetrically arranged, windings of the two AC permanent magnet synchronous exterior rotor motors are connected in series so as to drive the center shaft to rotate synchronously. Or, the driving devices arranged at the two ends of the center shaft can include an upper computer used to compare actual position information of the two ends of the center shaft. If the upper computer determines that synchronous deviation of the two ends of the center shaft exceeds a predefined value, the upper computer sends a compensation command to rotation performing parts at the two ends of the center shaft to adjust rotation angles, thus the two ends can be synchronously driven.

Furthermore, the big pulley 9 is connected to an upper small pulley 7 by a narrow synchronous belt 8, so that the small pulley 7 can be driven to rotate. The small pulley 7 is also connected to a rotation shaft of an encoder 6. A motor bracket 12, a motor connecting plate 13, an upper connecting plate 15, a first lower connecting plate 17 and a second lower connecting plate 18 shown in FIG. 5 are connecting and fixing elements. FIG. 5 also shows a grinding wheel shaft 22 used for connecting the grinding wheels to the grinding wheel spindle, a ball collar 14 shown in FIG. 5 is used as a bearing of the spindle of the torque motor, meanwhile, the ball collar can be used as a connection part between the upper and lower parts.

A bed body of the inventive grinding machine includes the pillar, the grinding machine base, the servo motor, the joint slack, the lead screw and supporting plates. The bed body of the grinding machine is a circular table with curve edges and can be uniformly forced. The base is a casting stone with abilities of damping vibration attenuation, good vibration absorption, good heat stability and high corrosion resistance.

Furthermore, the lead screw can be replaced by a linear motor. Therefore, two driving manner can be interchanged in the grinding machine so as to satisfy users' requirements. The linear motor has a high accuracy for driving and can be used with a grating ruler, the linear motor is a fully close-loop, and has a high detection accuracy, however, the cost of the linear motor is high. Compared with the grinding machine using the linear motor, the grinding machine using the lead screw and without a grating ruler has a lower detection accuracy, the lead screw is half close-loop, and the cost is low. The working process of the grinding machine using the lead screw is described as follow: the servo motor is connected to the lead screw by means of the joint slack, the lead screw is driven to rotate by the rotation of the servo motor, and a supporting plate (or a sliding platform) is driven to move by the rotation of the lead screw. The working process of the grinding machine using the linear motor is described as follow: the grating ruler is a detector and mounted on the base (or the sliding platform), the supporting plate (or the sliding platform) is driven to move by the linear motor after the linear motor is connected to electricity, and the supporting plate (or the sliding platform) drives a reading head to move.

An axis of motion of the sliding platform faces an axis of motion of the grinding wheel head bracket, the axis of motion of the sliding platform and an axis of a workpiece spindle can be collinear in order to symmetrically machine a workpiece, thus the sliding platform has small moving distance and good stability.

Additionally, the grinding wheel head bracket as a whole includes the encoder, the small pulley, the narrow synchronous belt, the big pulley, the spindle motors, the wide synchronous belt, the torque motors, the bearing of the rotation table, the spindle pulley and the spindle.

The working process of the inventive grinding machine is described as follow:

1. The two spindle motors are connected in series, and one controller is used, therefore, the cost is reduced.

2. The encoder is a detector and mounted on an upper end of a housing of the spindle motor, the big pulley is directly fixed on the spindle of the spindle motor, the small pulley is indirectly fixed on the shaft of the encoder, the big pulley and the small pulley are connected by the narrow synchronous belt, the two spindle motors are connected by a key connection and are controlled in series to synchronously rotate, then the encoder is driven to rotate by means of the narrow synchronous belt during the rotation of the spindle motors.

3. The spindle pulley is fixed on the spindle, the big pulley and the spindle pulley are connected by the wide synchronous belt, and the spindle is driven to rotate by the rotation of the spindle motor.

4. The grinding wheel shafts are arranged on both sides of the spindle, the grinding wheels are fixed on the grinding wheel shafts, when the spindle is rotating, and a cutter is ground by the grinding wheels.

5. The torque motors drive the spindle to freely rotate for 360 degrees by the bearing of rotation table. The grinding wheel head bracket can move up and down by means of the lead screw, the spindle can freely rotate for 360 degrees during the movement of the grinding wheel without interference.

6. The big pulley is mounted on the shafts of the two torque motors, the two torque motors have to be synchronous.

7. The wide synchronous belt passes through the center of the torque motors.

8. The grinding wheel head bracket is mounted on the pillar by the sliding rails, the lead screw is driven to move up and down by the grinding wheel head bracket by means of the servo motor. The cross-shaped sliding platform is driven to move along a straight line by the combination of the motor and the lead screw (or the sliding rails and the linear motor). The spindle of the workpiece is mounted on the supporting plate, a symmetric design is used, and the axis of the spindle of the workpiece faces an axis of the grinding wheel head bracket.

Figure 4:
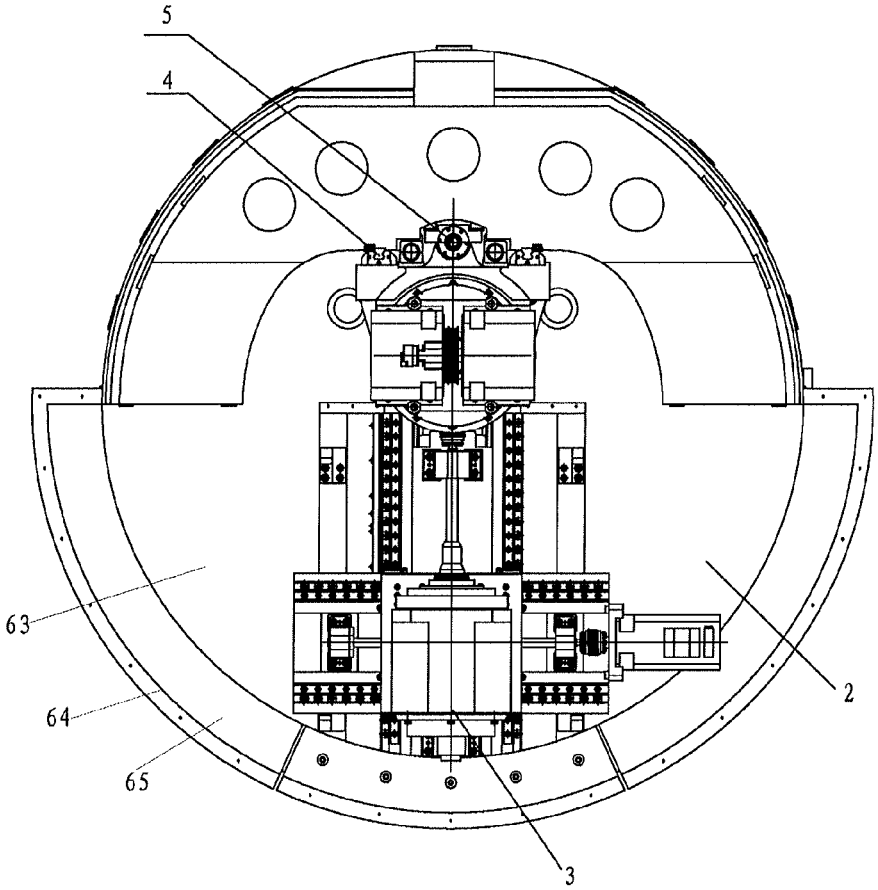
FIG. 4 is a schematic top structure view of the fully symmetric cutter grinding machine with 5-axis according to the present invention.

Additionally, the cutter grinding machine is shown in FIG. 1 and FIG. 4. The upper surface of the base 2 is circular. The curved pillar 56 with a radian of 180° is provided along a side edge of the base 2, a groove body 63 on the circular base is enclosed by a curved vertical plate on the another side edge, and the height of vertical plate is lower than that of the pillar. The inner side of the vertical plate used for enclosing the groove body 63 is a slope surface 65, the vertical plate is provided on an outer side of the outer edge of the base. In FIG. 2, the slope surface 65, enclosing plates 66 arranged on two ends of the curved vertical plate and the circular upper surface of the base forms the groove body 63 which is capable of accommodating cooling mediums.

The present invention has been further detailed in the above descriptions with reference to the preferred embodiments; however, it shall not be construed that implementations of the present invention are only limited to these descriptions. Many simple deductions or replacements may further be made by those of ordinary skill in the art without departing from the conception of the present invention, and all of the deductions or replacements shall be considered to be covered within the protection scope of the present invention.

The invention claimed is:

1. A fully symmetric cutter grinding machine with 5-axis, comprising a grinding machine base and a pillar arranged on one side of the grinding machine base, characterized in that:

sliding rails are vertically arranged on an inside of the pillar, the sliding rails are provided with a grinding wheel head bracket movable along the sliding rails;

the grinding wheel head bracket comprises torque motors vertically provided, a lower part of the torque motor is connected to a horizontally provided spindle by means of a bearing of a rotation table, grinding wheels rotating around an axis of the spindle are symmetrically provided at two sides of the spindle;

the grinding wheel head bracket further comprises a big rotatable pulley provided at an upper part of the grinding wheel head bracket, the big pulley is connected to a spindle pulley by a wide synchronous belt, the spindle pulley is disposed around a middle of the spindle so as to drive the spindle to rotate, two spindle motors are symmetrically arranged at two ends of a center shaft of the big pulley, the two symmetrical spindle motors are used for synchronously driving the center shaft of the big pulley to rotate.

2. The fully symmetric cutter grinding machine with 5-axis of claim 1, wherein the big pulley is connected to an upper small pulley by a narrow synchronous belt so as to drive the small pulley to rotate, and the small pulley is connected to a rotation shaft of an encoder.

3. The fully symmetric cutter grinding machine with 5-axis of claim 1, wherein the grinding machine base is a casting stone or natural marble.

4. A grinding wheel head bracket, wherein the grinding wheel head bracket comprises:

torque motors vertically provided, wherein a lower part of the torque motor is connected to a horizontally provided spindle by means of a bearing of a rotation table, grinding wheels rotating around an axis of the spindle are symmetrically provided at two sides of the spindle;

a big rotatable pulley provided at an upper part of the grinding wheel head bracket, wherein the big pulley is connected to a spindle pulley by a wide synchronous belt, the spindle pulley is disposed around a middle of the spindle so as to drive the spindle to rotate, two spindle motors are symmetrically arranged at two ends of a center shaft of the big pulley, the two symmetrical spindle motors are used for synchronously driving the center shaft of the big pulley to rotate.

5. The grinding wheel head bracket of claim 4, wherein the big pulley is connected to an upper small pulley by a narrow synchronous belt so as to drive the small pulley to rotate, and the small pulley is connected to a rotation shaft of an encoder.

* * * * *